US007185512B2

(12) United States Patent
Badie et al.

(10) Patent No.: US 7,185,512 B2
(45) Date of Patent: Mar. 6, 2007

(54) INSTALLATION FOR THE VERY LONG STORAGE OF PRODUCTS THAT EMIT A HIGH HEAT FLUX

(75) Inventors: Michel Badie, Treffiagat (FR); Bernard Duret, Saint Martin le Vinoux (FR)

(73) Assignee: Commissariat a l'Energie Atomique, Paris (FR)

( * ) Notice: Subject to any disclaimer, the term of this patent is extended or adjusted under 35 U.S.C. 154(b) by 108 days.

(21) Appl. No.: 10/500,460

(22) PCT Filed: Jan. 21, 2003

(86) PCT No.: PCT/FR03/00184

§ 371 (c)(1),
(2), (4) Date: Jan. 11, 2005

(87) PCT Pub. No.: WO03/063180

PCT Pub. Date: Jul. 31, 2003

(65) Prior Publication Data

US 2005/0103049 A1 May 19, 2005

(30) Foreign Application Priority Data

Jan. 23, 2002 (FR) ..... 02 00805

(51) Int. Cl.
*F25B 39/02* (2006.01)

(52) U.S. Cl. ..... 62/515; 165/169; 405/129.55

(58) Field of Classification Search ..... 165/47, 165/104.11, 169, DIG. 353; 62/515, 527; 405/129.55, 129.45
See application file for complete search history.

(56) References Cited

U.S. PATENT DOCUMENTS 3,197,974 A * 8/1965 Smith et al. ..... 62/320
3,279,525 A * 10/1966 Takahashi ..... 159/3
3,335,789 A * 8/1967 Raskin ..... 165/80.5
4,040,480 A * 8/1977 Richards ..... 166/57
4,061,534 A * 12/1977 Jackson ..... 376/287
4,206,312 A * 6/1980 Kuhlmann ..... 373/76
4,213,498 A * 7/1980 Vandenbossche ..... 165/136
4,634,875 A * 1/1987 Kugeler et al. ..... 250/506.1

(Continued)

FOREIGN PATENT DOCUMENTS

DE 3822212 C1 * 7/1988

(Continued)

*Primary Examiner*—Mohammad M. Ali
(74) *Attorney, Agent, or Firm*—Oblon, Spivak, McClelland, Maier & Neustadt, P.C.

(57) ABSTRACT

An installation for very long term storage of products emitting a high thermal flux. The installation comprises a container (14), in which the products to be stored are placed, and an evaporator (22) surrounding the container, to evacuate the heat through a heat-pipe effect. The evaporator (22) comprises a jacket (28), pipes (32) integral with the jacket and filled with a coolant fluid such as water, and a system for tightening the evaporator (22) on the container (14). The arrangement is such that the evaporator (22) is not maintained in close contact with the container (14) except in front of the pipes (32). Advantageously, channels (42) are provided for air circulation by natural convention between the evaporator (22) and the container (14), on both sides of the pipes (32).

15 Claims, 6 Drawing Sheets

U.S. PATENT DOCUMENTS

| | | | | |
|---|---|---|---|---|
| 4,649,018 | A * | 3/1987 | Waltersdorf et al. | 376/272 |
| 4,672,213 | A * | 6/1987 | Stoll et al. | 250/506.1 |
| 5,564,498 | A | 10/1996 | Bochard | |
| 6,802,671 | B1 * | 10/2004 | Badie et al. | 405/129.55 |

FOREIGN PATENT DOCUMENTS

| | | |
|---|---|---|
| FR | 2 791 805 | 10/2000 |
| GB | 1 408 396 | 10/1975 |

* cited by examiner

INSTALLATION FOR THE VERY LONG STORAGE OF PRODUCTS THAT EMIT A HIGH HEAT FLUX

TECHNICAL FIELD

The present invention relates to a storage installation, that is to say storage under surveillance and reversible, for a very long time period (more than 50 years), of calorific products emitting a high thermal flux.

Such a storage installation can, in particular, be used for very long term storage of nuclear waste such as irradiated nuclear fuels. The storage of such products requires temperature control of the containers in which they are placed.

STATE OF THE ART

Very long term storage of calorific products such as nuclear waste is usually carried out by processing the waste in containers and then placing the latter in cavities made in the ground with limits defined by concrete walls.

The high thermal flux generated by the calorific products must be evacuated by a cooling system to stabilise the surface temperature of the containers. This makes it possible to ensure the stability of the container structures and the calorific products they hold. This also makes it possible to ensure the stability of the concrete of the surrounding walls. Preferably, the cooling systems are passive.

In the document FR-A-2 791 805, a very long term storage installation is proposed for calorific products. In this installation, the thermal power is extracted as close as possible to the sealed barrier represented by the container, without intrusion and in a passive manner, before being evacuated from the site to the exterior by a non-contaminable cooling circuit.

More precisely, this document proposes surrounding each container tightly, over the whole of its external cylindrical surface, with a flexible and removable jacket consisting, for example, of a tightened and stapled thin metal sheet surrounding the container in such a way that the smooth external surfaces of the container and the jacket are normally in contact. The application of the jacket on the external surface of the container is ensured by tightening at several points during closure (or stapling) of the jacket.

Externally the jacket is equipped, at regular intervals (for example about 20 cm), with vertical pipes of either circular or square cross-section. These pipes are intimately linked to the jacket, from a thermal conduction point of view, in such a way as to form an evaporator for the coolant fluid. Preferably, this fluid functions in bi-phase liquid-vapour regimen and constitutes a heat pipe with the circuit in which it is confined. The heat pipe condenser is set outside the site, where heat exchange takes place with the free air circulating by natural convection.

In this known installation, the transmission of the thermal flux from the container is ensured, on the one hand, by direct contact of the container walls and the metal sheet forming the jacket and, on the other hand, by contact between said metal sheet and the pipes it supports.

According to another embodiment described in document FR-A-2 791 805, the pipes are integral with the jacket sections, themselves assembled end to end by welding or by any other mechanical connection means. In this case, the thermal efficiency of the system depends only on the quality of the contact between the containers and the juxtaposed jacket sections.

In all cases, the quality of heat transfer rises when the contact resistance falls, that is to say when the contact between surfaces is closest. In other terms, good heat flux transfer between the container and the flexible jacket surrounding it depends on the thickness of the residual air film between the two walls being limited to a fraction of a millimetre.

A cooling supplement is usually brought by the surrounding air, in constant natural convection at the external surface of the heat pipe jacket. In order to ensure cooling if there is an incident or an accident, means for producing forced convection movement of air can be provided. The heat transfer increases with the external surface of the jacket, when the latter is made of a heat-conducting material and when the contact resistance between the container and the jacket is low. Furthermore, in a preferred embodiment, the pipes can be provided with cooling fins in order to increase the transfer surface between the jacket and the surrounding air and to provide a longer period of time for intervention in the case of accident.

Modelling and then experiments carried out on scale 1, on containers of 2 metres diameter, resulted in obtaining the performance described in document FR-A-2 791 805.

Continuation of this work and its orientation towards industrialisation revealed the difficulty of obtaining an average play of less than 0.3 mm between the containers and the jacket surface. Such precision, obtainable on a prototype, is difficult to reproduce on an industrial scale with traditional tools and any attempt to reduce the play, for example to 0.1 mm, raises manufacturing costs enormously. But, this average play constitutes the most important parameter for the performance of installations.

DESCRIPTION OF THE INVENTION

The aim of the invention is a very long term storage installation for calorific products, comparable to the installation described in FR-A-2 791 805 but whose original design enables at least comparable performances to be obtained in a much simpler and less costly manner, using traditional industrial means.

According to the invention, a very long term storage installation for calorific products is proposed, comprising at least one confinement container for said products, an evaporator comprising a jacket surrounding the container and a plurality of pipes integral with the jacket and filled with a coolant fluid, and means for tightening the evaporator on the container, characterised in that the evaporator has an internal surface such that the tightening means keep the evaporator in close contact with an external surface of the container only in front of each of the pipes.

Design studies and modelling of such an installation together with tests concerning certain sensitive characteristics such as the interface between the jacket and the container showed that limiting the contact surfaces between the container and the jacket to restricted zones in front of the pipes made it possible to obtain, with traditional industrial means and therefore at reasonable cost, just as efficient heat transfer between the container and the pipes as that which would have been obtained, in the installation according to prior art shown by document FR-A-2 791 805 when setting a constant average play between the container and jacket at about 0.1 mm, which is very difficult to obtain industrially.

Advantageously, the internal surface of the evaporator, between the pipes, has a radius of curvature that is substantially higher than that of the external surface of the container.

Preferably, since the contact zone between the container and each of the pipes has a well defined surface and is not limited to a line, particularly in the case of pipes with circular cross-section, the internal surface of the evaporator comprises, in front of each of the pipes, a part with shape complementary to the external surface of the container, maintained in close surface contact with said external surface by tightening means.

According to a first embodiment of the invention, the pipes are fixed, preferably by welding, inside a continuous structure, of almost circular cross-section, forming the jacket. In this case, the pipes can include cooling fins, located between the jacket and the container.

According to a second embodiment of the invention, each pipe consists of a single piece with two jacket sections, and the neighbouring pipe sections are assembled together edge to edge to form the jacket. The neighbouring pipe sections can then be assembled either by welding or by any mechanical connection means whatsoever.

The pipes can have either a substantially square or rectangular cross-section, or a substantially circular cross-section. In the latter case, advantageously the pipes have flanges with an internal face maintained in close surface contact against the external surface of the container by the tightening means.

As an option, an external surface of the evaporator can include cooling fins.

Finally, according to a particularly advantageous improvement of the invention, outside the zones located in front of the pipes, the evaporator is separated from the container in such a way as to define vertical channels for air circulation, by natural convection. In a variant of an embodiment of the invention, the channels are then part of a closed circuit constituting a supplementary confinement barrier.

BRIEF DESCRIPTION OF THE DRAWINGS

Next, as illustrative and non-limiting examples, various embodiments of the invention will be described, with reference to the attached drawings, in which.

DETAILED DESCRIPTION OF PREFERRED EMBODIMENTS ACCORDING TO THE INVENTION

Figure 1:
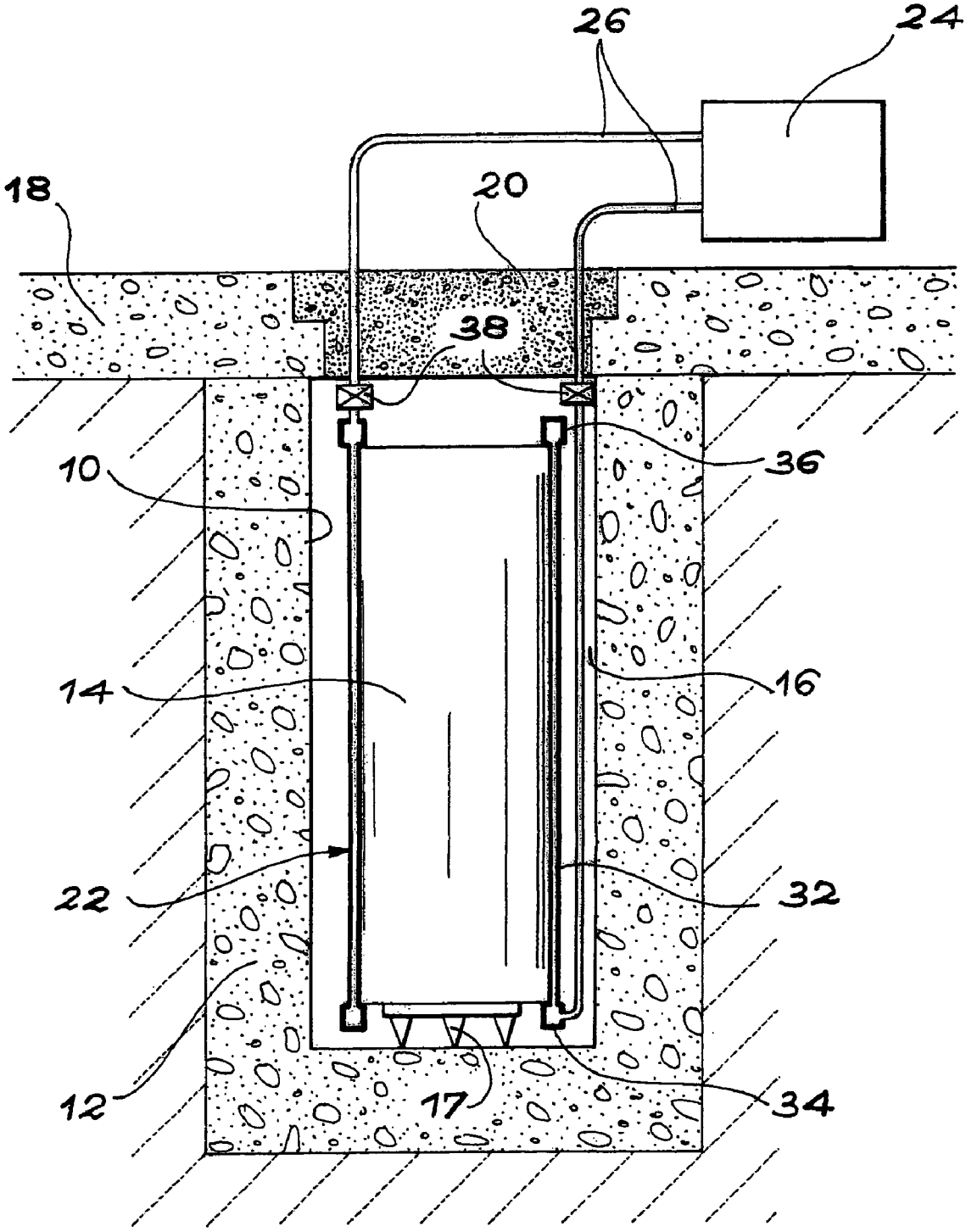
FIG. 1 is a vertical cross-section representing very diagrammatically a part of a storage installation for calorific products according to the invention.

In FIG. 1, part of an installation according to the invention is shown diagrammatically, intended for very long term storage of calorific products such as nuclear waste consisting, for example, of irradiated nuclear fuels.

In its general configuration, this installation is comparable to that described in document FR-A-2 791 805. For more details, this document can well be consulted.

In order to understand the invention fully, it is simply noted here that the installation comprises a closed cavity 10, defined laterally and towards the bottom by concrete walls 12. The dimensions of the cavity 10 are such that one or several containers 14 can be housed, in which the nuclear wastes to be stored are processed. The containers 14 have the shape of cylindrical drums and they are placed in the cavity 10 with their axes oriented closely vertical. There is a space 16 between each container 14 and the walls 12 of the cavity 10 to allow circulation of the surrounding air, by natural convection. Thus, the container 14 rests on the base of the cavity 10 on top of a pedestal 17.

The cavity 10 is closed at the top by a concrete slab 18, including a removable plug 20 on top of each of the containers 14.

In order to ensure evacuation of the heat emitted by the processed nuclear waste in the containers 14 by a passive method, meaning without a supply of external energy, a heat pipe is associated with each container. More precisely, this heat pipe comprises an evaporator 22 surrounding the container 14, an air condenser 24 placed above the slab 18 and two ducts 26 linking the evaporator 22 to the air condenser 24 through the plug 20. The air condenser 24 can be common to several containers 14.

A cooling fluid such as water at 100° C. is placed in the heat pipe. The phase changes of this fluid (evaporation/condensation) in the heat pipe ensure transfer of the heat emitted by the nuclear waste from the hot source constituted by the container 14 to the cold source constituted by the air condenser 24.

Figure 2:
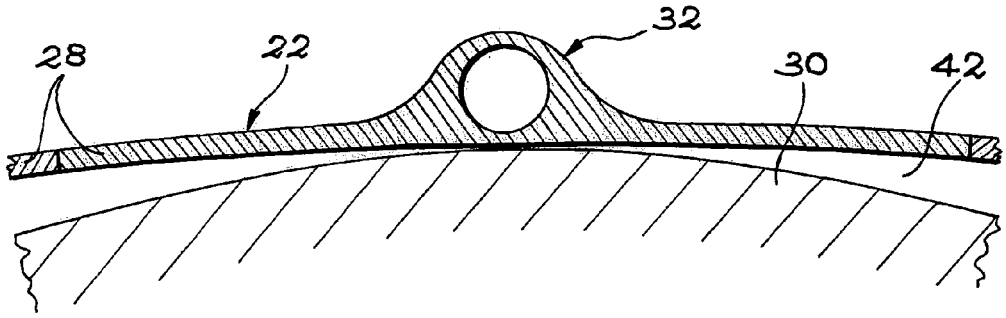
FIG. 2 is a horizontal cross-section illustrating diagrammatically a part of an evaporator according to the invention, in quasi-linear contact with a container set in the installation.

As shown diagrammatically in FIG. 2, the evaporator 22 comprises a jacket 28, closely surrounding the totality of the external peripheral surface 30 of the container 14, and a plurality of pipes 32 integral with the jacket 28. The pipes 32 are parallel to each other and also to the closely vertical axis of the container and they are spaced in a substantially regular fashion at equal distances from each other, around the whole periphery of the container.

With reference again to FIG. 1, it can be seen that the pipes 32 are linked to an annular distributor of liquid water 34 at their lower ends and in an annular collector of vaporised water 36 at their upper ends. The distributor 34 and the collector 36 are linked separately to the air condenser 24 by one of the ducts 26 and the latter comprise removable connections 38, below the plug 20. The pipes 32 as well as the collectors 34 and 36 are filled with the cooling fluid contained in the heat pipe.

The evaporator 22 is mounted on the container 14, in a removable way, by tightening means 40, and an example will be described below with reference to FIG. 4.

According to the invention and as illustrated diagrammatically in FIG. 2, the internal surface of the evaporator 22, that is the surface of the evaporator facing the container 14, is produced in such a way that the tightening means 40 maintain the evaporator 22 in close contact with the external surface 30 of the container 14 only in front of each of the pipes 32. Thus, the parts of the jacket 28 that are in place between the pipes 32 are separated from the external surface 30 of the container 14, in such a way as to form vertical channels 42, of closely uniform or variable thickness, between the jacket 28 and the container 14. These channels 42 constitute a sort of chimney generating air circulation around the container 14, by natural convection.

This air circulation can be mainly laminar or turbulent, according to the specific power dissipated by the container, the height of the container and, to a lesser degree, by the diameter of the container. The turbulent character of the flow improves the cooling of the container. It is encouraged by a specific thermal power equal to or greater than 1 $kW/m^2$ and by an increase in the height of the container and the radial thickness of the vertical channels 42.

Tests were carried out with specific thermal powers ranging from 1 $kW/m^2$ to over 3 $kW/m^2$ and, more particularly, around 2.5 $kW/m^2$. The heights were comprised between 2 m and 5 m, the greatest height improving the efficiency of heat transfer. To ensure that the circulation in the vertical channels 42 has significant efficiency, the radial thickness must be greater than 1 cm; this is the reason why the tests were carried out preferably with radial thicknesses comprised between 4 cm and 12 cm.

For annular geometry, the production of a chimney effect by natural convection is controlled by three parameters as follows:

- the height of the chimney; in the present case the height of the chimney is between 5 and 6 metres when the container is filled with irradiated fuels, which generates a very strong draught. Nonetheless, a height of 1 metre corresponding to a container filled with hot objects of shorter length produces the same proportional efficiency;
- the presence of the cylindrical container generating the thermal flux: the container is an excellent generator of thermal flux; this flux can be considered to be homogeneous on the cylindrical wall, and
- the width of the annular space ΔR between the container and the jacket, for a given diameter; in the present case, the width of the annular space 42 alone is not sufficient for defining the convection in this geometry; thus the relationship between the radii R1 of the container and R2 of the jacket must be taken into account.

The air movement is caused by the variation of volumic mass of the fluid submitted to a force field. The grouping governing the natural convection is the Grashof number Gr, but the correlations generally allowed bring in the intervention of the Rayleigh number.

For a container diameter of around 2 metres, calculations demonstrate that the chimney effect begins to develop from ΔR=1 cm. The effect then increases with ΔR to reach an optimum value of about 5 to 6 cm (the definition of this optimum value depends here on maximum utilisation of a high yield heat pipe evaporator, coupled with a high performance cooling system by natural convection). This optimum value corresponds to an extraction value by natural convection of about 40% of the extracted total power (conduction+radiation+natural convection in channels 42+external natural convection). With ΔR=4 cm, the percentage of power extracted by the chimney type effect is about 25 to 30% of the total. This value was validated experimentally on a model of 2 m diameter, 1.5 m height and a thermal flux of 2.5 $kW/m^2$. The value ΔR=4 cm corresponds to the external dimensions of a square tube of 40 mm×40 mm whose internal cross-section is needed for stable operation in diphase siphon mode (passive mode).

Beyond ΔR=about 6 to 7 cm, the chimney type effect does not increase any more, and it tends to decrease towards natural convection in free space for ΔR>10 cm.

These values are justified in a coupled situation of power extraction both by the heat pipe (to take greatest advantage of extraction by conduction) and by the natural chimney convection.

The gain in performance of the system, subject of the present invention is, optimally, about 20%. For equal generated power in the container, this results in a significant lowering of the skin temperature of the container by about. 10 to 20° C. (depending on the nature of the different materials) and for thermal fluxes of 2 to 3 $kW/m^2$. This addition is therefore very significant.

As shown diagrammatically in FIG. 2, the contact between the evaporator 22 and the container 14 can be limited to quasi-linear zones corresponding to the generatrix lines of the container 14 situated at right angles to each of the pipes 32.

Figure 3:
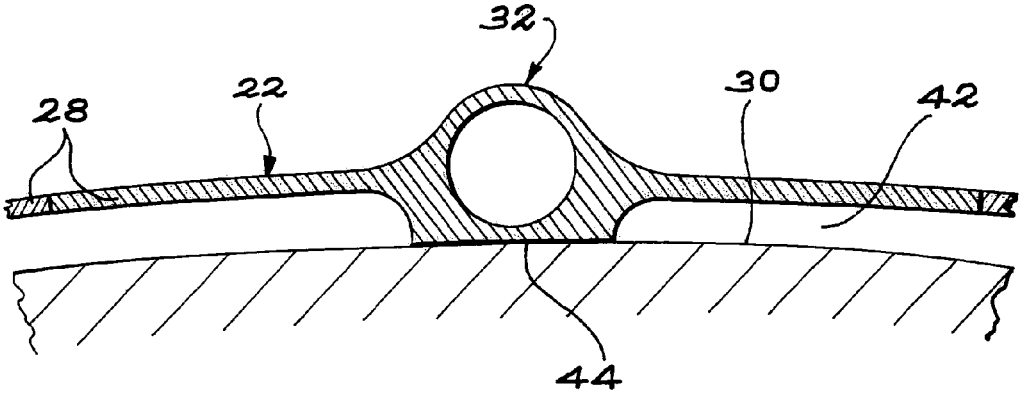
FIG. 3 is a view comparable to FIG. 2, showing diagrammatically the case of an evaporator in surface contact with a container holding calorific products.

In order to improve the heat exchange even further, the internal surface of the evaporator 22 can also comprise, on the right of each of the tubes 32, a part 44, of limited width, whose shape is complementary to that of the external surface 30 of the container 14, as shown in FIG. 3. Application of the tightening means 40 (FIG. 4) then has the effect of maintaining these parts 44 in close surface contact with the external surface 30 of the container 14.

The quasi-selective contact of FIG. 2 like the surface contact of FIG. 3 can be obtained by providing the internal surface of the evaporator 22, between the pipes 32, with a radius of curvature greater than that of the external surface 30 of the container 14. Thus, as a non-limiting example, in the case of a container with a radius of 1000 mm, the parts of the evaporator 22 located between the pipes 32 can have a radius of about 1200 mm. The maximum play between the evaporator and the container is then, for example, 0.85 mm. In the case of quasi-selective contact such as that shown in FIG. 2, an average play of about 0.45 mm is obtained inside the channels 42.

Figure 4:
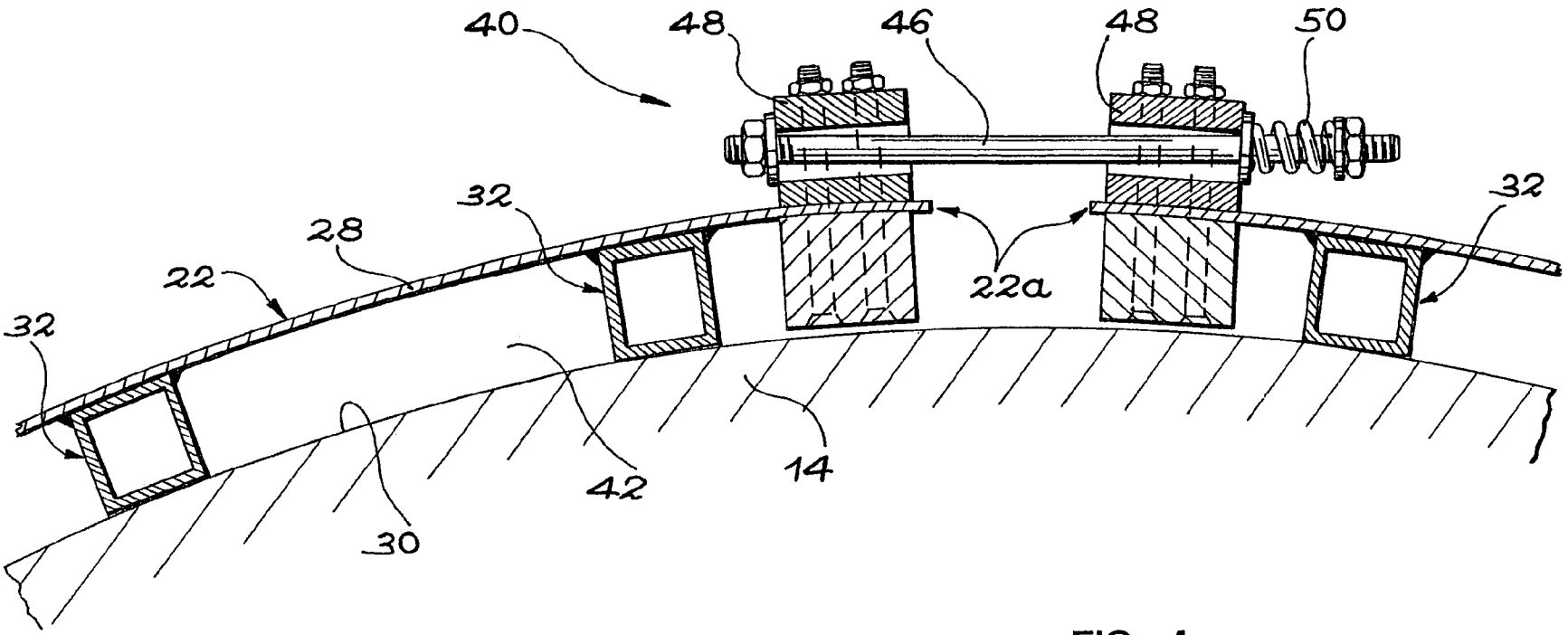
FIG. 4 is a cross-section comparable to FIGS. 2 and 3, representing an evaporator according to a first embodiment of the invention in greater detail, and the associated tightening means.

In a first embodiment according to the invention shown in FIG. 4, the jacket 28 takes the form of a continuous structure, of closely circular cross-section and of small thickness, surrounding the container 14 at a distance. This structure is constituted, for example, of metal sheet. The pipes 32 are then fixed inside the jacket 28 by any appropriate means. Advantageously, this fixation is ensured by welded points.

FIG. 4 also shows a possible embodiment of the tightening means 40.

As shown in FIG. 4, the evaporator 22 is open along a generatrix and comprises two opposite edges 22*a*, oriented parallel to the axis of the container 14. The tightening means 40 are set between the two edges 22*a*. More precisely, the tightening means 40 comprise a plurality of bolts 46, that cross the holes formed in the parts 48, set along the edges 22*a* of the evaporator, on its outwards facing surface. A helicoidal compression spring 50 is mounted on each of the bolts 46, in such a way as to maintain the tightening force substantially constant in the hypothesis of possible differential dilatations between the container 14 and the evaporator 22.

Figure 5:
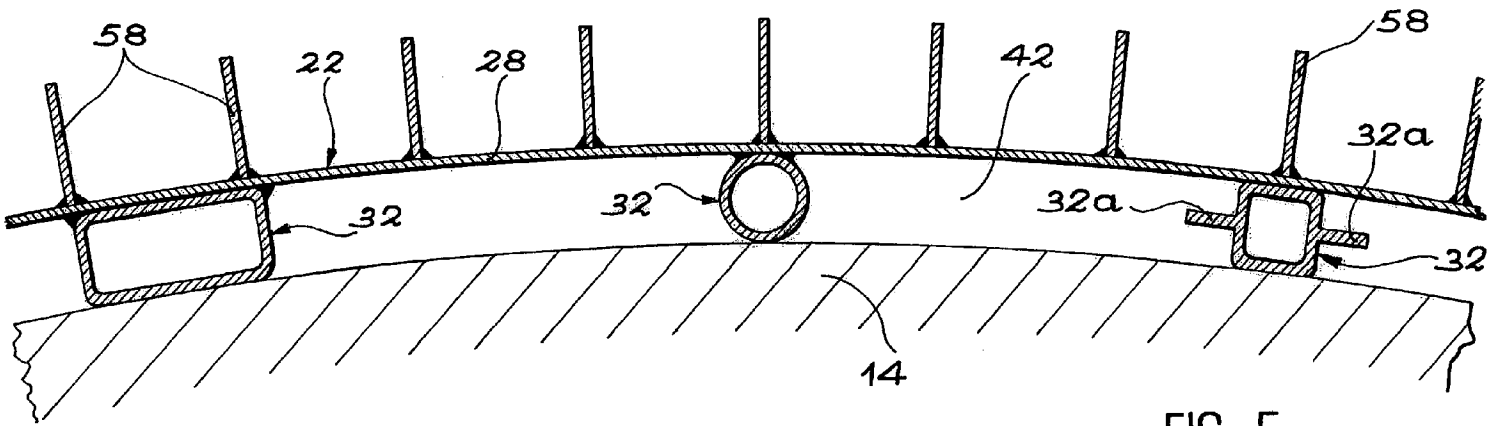
FIG. 5 is a cross-section comparable to FIG. 4, showing side-by-side three variants of possible cross-sections for the evaporator pipes, as well as the presence of optional cooling fins on the jacket.

FIG. 5 shows different variants together of the first embodiment of the invention described with reference to FIG. 4. In practice, it is understood that these variants are alternative solutions, generally implemented separately from each other, apart from contrary indications.

The different variants shown in FIG. 5 relate first of all to the shape of the pipes 32. Thus, in any case, these pipes can have a circular, square or rectangular cross-section, that is to say flattened in the direction of their thickness. The thermal evacuation is increasingly efficient when the contact surface between the container and the parts of the evaporator located in front of the pipes increases, that is to say changing from pipes of circular cross-section to pipes of rectangular cross-section. Nonetheless, the extent of this contact surface must remain sufficiently low so that close contact can be obtained without difficulty.

As a non-limiting illustration, the pipes 32 can be set every 200 mm and have a cross-section of 40×40 mm or 60×60 mm, in the case of square pipes.

As shown in the right-hand part of FIG. 5, the heat exchange between pipes 32 and the air circulating in the annular spaces 42 can be improved by equipping the pipes with cooling fins 32*a*, located between the jacket 28 and the container 14. These fins 32*a* can be added onto the pipes 32 of any cross-section shape whatsoever or can be made in a single piece with said pipes, under the form of extruded profiles.

Figure 6:
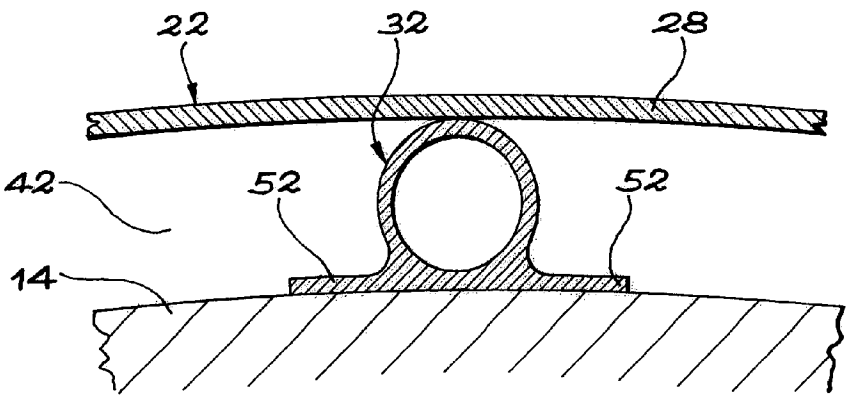
FIG. 6 is a cross-section comparable to FIGS. 4 and 5, showing another variant of the first embodiment of the invention.

As shown in FIG. 6, in the case where pipes of circular cross-section are used, the heat exchange can be improved by equipping each of the pipes 32 with flanges 52, on the side of the container 14. The internal face of the flanges 52 is then maintained in close surface contact against the external surface 30 of the container 14.

Figure 7:
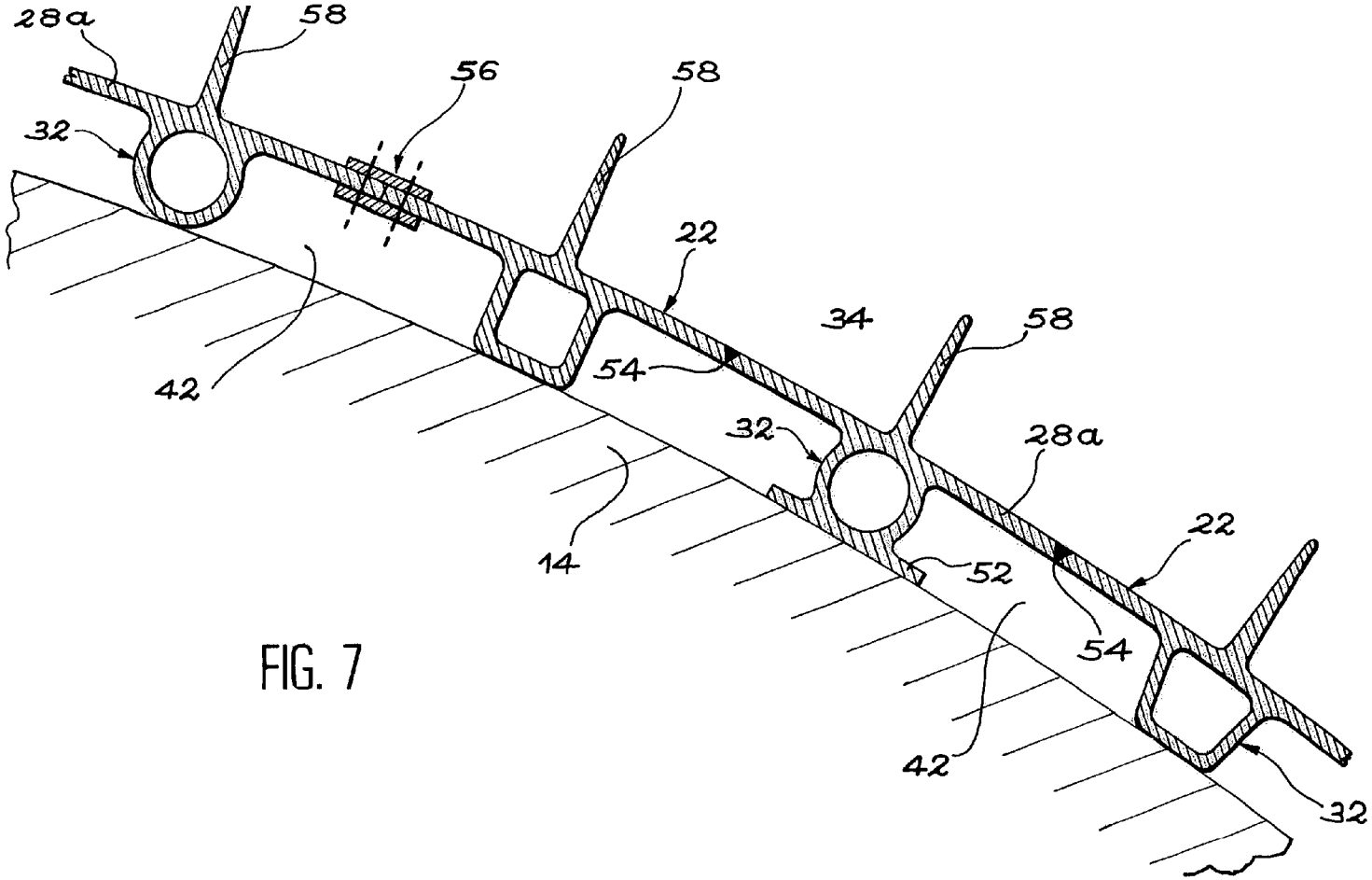
FIG. 7 is a cross-section comparable to FIGS. 4 to 6, showing side-by-side three variants of a second embodiment of the invention.

In FIG. 7, different possible variants are shown for an evaporator according to a second embodiment of the invention.

In this second embodiment, the jacket 28 and pipes 32 are made in a single piece. More precisely, each of the pipes 32 is made in a single piece with two sections 28*a* of the jacket 28. Each of the sections 28*a*, in cross-section in a horizontal plane, has the shape of an arc of a circle whose length is equal to half the length of the jacket between two consecutive pipes 32. The sections 28*a* of the neighbouring pipes 32 are assembled together edge to edge, following the generatrix lines of the container 14, to form the jacket 28.

Edge to edge assembly of the sections 28*a* can be ensured either by welding 54 or by mechanical connection means 56, such as fish joints or other, as shown in FIG. 7.

When the pipes 32 have a circular cross-section, they can comprise flanges 52, as described above with reference to FIG. 6, within the framework of the first embodiment according to the invention. The flanges 52 are then constituted of an internal face with a shape complementary to that of the external cylindrical shape of the container 14. In this case, the tightening means associated with the evaporator keep the internal face of each of the flanges 52 in tight surface contact, meaning without play, against the external surface of the container 14.

It is also shown in FIG. 7 that each of the parts in a single piece consisting of a pipe 32 and two jacket sections 28*a* can also comprise one or several cooling fins 58 on its surface facing outwards, that is away from the container 14. In the first embodiment according to the invention, shown in FIGS. 4 to 6, such cooling fins 58 (FIG. 5) can also be envisaged. In this case, the fins 58 are added by welding them onto the external surface of the metal sheet forming the jacket 28.

In the second embodiment according to the invention, the tightening means can be similar to those used in the first embodiment, such as described above with reference to FIG. 4.

Modelling of finished elements made by the applicant showed, surprisingly, than an evaporator 22 with limited surface contact with the container 14 (corresponding to a play of 0.01 mm), at right angles to the heat pipe tubes 32, according to the invention, makes it possible to obtain thermal properties essentially identical to those obtained by using an evaporator according to the prior art described in the document FR-A-2 791 805, in which a uniform play of 0.1 mm is obtained over the whole interface between the evaporator and the container. This result is particularly advantageous from an industrial point of view because it is much easier to ensure limited local contact at right angles to the pipes 32 than to obtain a uniform play of 0.1 mm over the entire surface of the evaporator 22.

Figure 8:
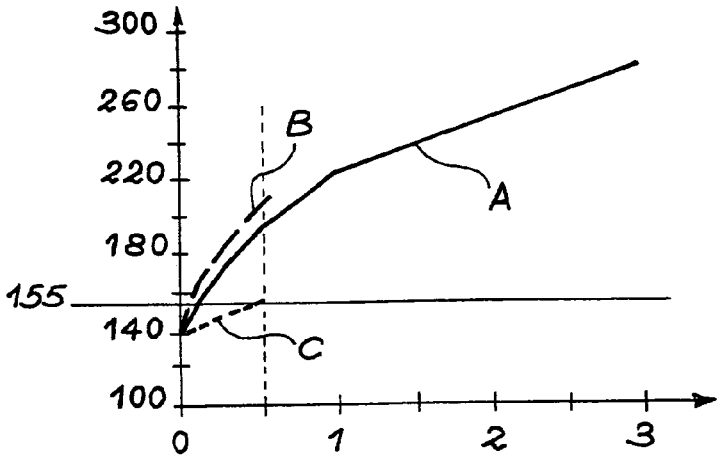
FIG. 8 shows three curves illustrating the evolution of the average temperature (in ° C.) within the thickness of a container holding a calorific product, in function of the average play (in mm) between the evaporator and the container, respectively in the case of constant play (curve A), in the case of contact between the pipes (curve B) and in the case of contact in front of the pipes according to the invention (curve C)

These results are shown in FIG. 8, which represents an orthonomic reference on which the abscissae show the average play (in mm) between the evaporator 22 and the container 14 and the ordinates show the average temperature (in ° C.) in the thickness of the container 14. More precisely, curve A corresponds to the case of an evaporator of prior art, in which constant play is envisaged between the evaporator and the container, curve B corresponds to the case of an evaporator intended to be in contact locally with the container only between the pipes, and curve C corresponds to the case of an evaporator 22 in accordance with the present invention, meaning in local contact with the container 14 only in front of the pipes 32.

As Table 1 below also demonstrates, it can be seen that the efficiency of the heat pipe depends essentially on the play under the pipes 32 and only to a small degree on the average play between the evaporator 22 and the container 14. For example, if the maximum temperature of the container is fixed at 155° C., it can be seen from Table 1 that this result can be obtained with an average play of 0.5 mm and a contact in front of the pipes 14 according to the invention. This result is comparable to that obtained in the case of a uniform play of 0.1 mm according to prior art, which is very difficult to obtain.

TABLE 1

| | Average temperature inside the container (in ° C.) | | |
|---|---|---|---|
| Average play (mm) | Uniform play | Contact in front of pipes | Contact between pipes |
| 0.01 | 138 | | |
| 0.05 | | 140 | 150 |
| 0.1 | 153 | | |
| 0.3 | 175 | 149 | 186 |
| 0.5 | 193 | 155 | 203 |
| 1 | 224 | | |
| 3 | 283 | | |

The presence of an average play of 0.5 mm with contact between the evaporator 22 and the container 14 in front of the pipes 32, according to the invention, means that the play is nil at right angles to the pipes 32 (that is to say, equal to 0.01 mm in the case of the modelling) and that it evolves linearly up to 1 mm in the middle of the arc of a circle formed in cross-section by the evaporator between two neighbouring pipes 32. Such an arrangement is perfectly practicable with traditional industrial means. In fact, for equal thermal yield, it makes it possible to multiply the average play by five on condition that the contact zones are localised in front of the pipes 32.

As described with reference to FIGS. 2 and 3, the contact zones can be quasi-linear or, preferably, can take the shape of narrow surfaces extending over the whole height of the container.

Figure 9:
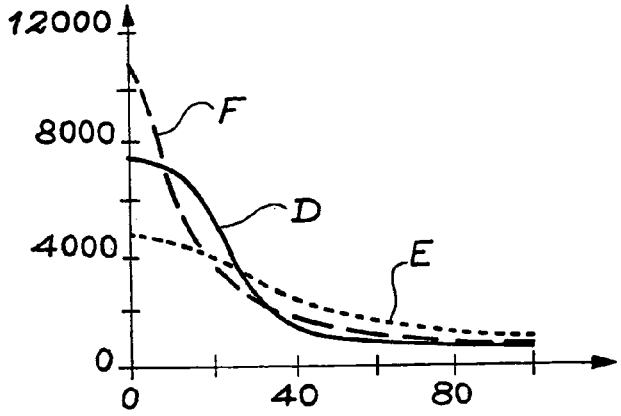
FIG. 9 shows the distribution of thermal flux (in $W/m^2$) in function of the distance (in mm) from the axis of a pipe, in the direction of the circumference of the container, respectively in the case of constant play of 0.01 mm (curve D), in the case of constant play of 0.3 mm (curve E) and in the case of contact in front of the pipes and an average play of 0.3 mm (curve F)

In FIG. 9, the evolution of thermal flux (in $W/m^2$) is shown in function of the distance from the axis of a pipe 32 (in mm), on the arc of a circle formed in cross-section by the evaporator 22. More precisely, this evolution is shown by D in the case of a constant play of 0.01 mm between the evaporator 22 and the container 14, by E in the case of a constant play of 0.3 mm and by F in the case of a linear contact in front of the pipes 32 and an average play of 0.3 mm.

It can be seen from FIG. 9 that the distribution of thermal flux closely depends on the nature of the play between the evaporator and the container. In particular, it can be noted that the major part of the thermal flux is transferred in the zones close to the pipes 32 and that this phenomenon is accentuated when the play under the pipes diminishes. Thus, in the case of a constant play of 0.3 mm, half the thermal flux is transferred in 31 mm starting from the pipes (curve E), whereas this distance falls to 18 mm in the case of a constant play of 0.01 mm (curve D) and to 17 mm in the case of linear contact under the pipes with an average play of 0.3 mm (curve F). The results shown in FIG. 9 thus confirm the interest of privileging contacts at right angles to the pipes 32 in accordance with the invention. These results were confirmed experimentally using a model for thermal testing.

By replacing the linear contacts under the pipes 32 by surface contacts, this phenomenon was accentuated. Consequently, it is then no longer half but the totality of the thermal flux that is transferred under the pipes 32.

Figure 10:
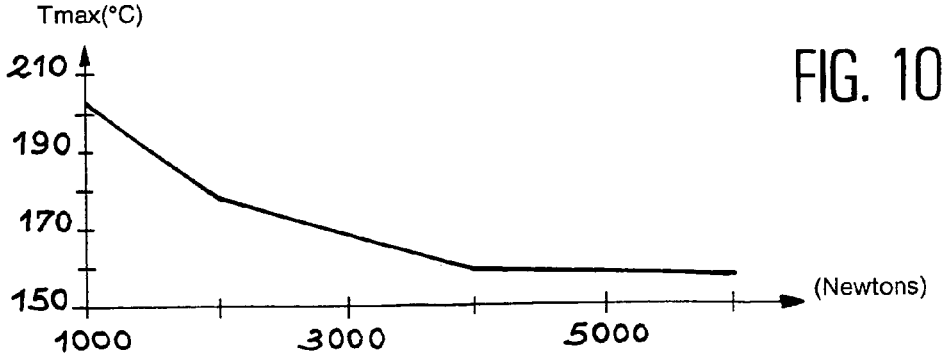
FIG. 10 shows the evolution of the maximum temperature of the container (in ° C.) in function of the tightening force applied on the evaporator (in Newton).

The influence of tightening forces applied to the evaporator 22 by the tightening means 40 was also studied. The results of this study are shown in FIG. 10. This figure represents the evolution of the maximum temperature of the container (in ° C.) in function of the tightening force (in Newton). It can be seen that the temperature falls when the tightening force is increased from 0 to 4000 N, but that beyond 4000 N any increase in tightening force has no effect. Tightening means 40 such as those described with reference to FIG. 4 make it possible to reach the value of 4000 N without any particular problem.

An evaporator 22 according to the invention, produced by combining the principle of quasi-linear contact of FIG. 2 with the second embodiment described with reference to FIG. 7 (jacket sections 28*a* and pipes 32 in a single piece), was first tested with the numerical values indicated above with reference to FIG. 2 (container of 1000 mm radius, evaporator of radius of curvature equal to 1200 mm, maximum play of 0.85 mm, quasi-linear contact under the pipes). The experiment confirmed that this evaporator was thermally equivalent to a prior art evaporator with an average play of 0.01 mm relative to the container, which is very difficult to obtain in practice.

After this, an evaporator 22 was produced combining the characteristics of FIG. 3 (surface contact) and the second embodiment of the present invention. In this case, the contact surface at right angles to the pipes 32 must not be too wide, because of the risk of encountering the problems of implementation characteristic of prior art. Thus it appears that, for a container 14 of 2000 mm diameter, contact zones of from 40 to 60 mm wide constitute a good compromise between obtaining greatly increased thermal yield and uncomplicated production.

Since the biggest part of the jacket 28 takes part only very partially in the passage of thermal flux, the first embodiment described above with reference to FIGS. 4 to 6 constituted a third experimental stage. In fact, this embodiment makes it possible, at reduced cost, to maintain an acceptable thermal yield. By placing the jacket 28 at a distance from the container 14 equal to the external dimensions of the pipe 32, all the manufacturing tolerances disappear. The jacket 28 forms a continuous circular structure making it possible to gird the pipes 32 and to hold them on the container 14.

Furthermore, an annular space, crown shaped, is created between the jacket and the container. This space corresponds to the channels 42 of FIG. 2. It encourages the development of a sort of chimney effect, allowing the ambient air thus channelled to circulate vertically under the effect of natural convection, whose drive is the thermal power of the container 14. Thus very efficient independent passive cooling is produced, since it results from direct contact with the container. This cooling effect adds up to that of the heat pipe in contact with the container. The total yield of this embodiment is therefore greater than that of prior art, for a much lower cost.

It can be considered that the natural convection of the air outside the jacket 28 is not affected significantly and that this phenomenon is added to the two preceding phenomena.

Such turbulence in the vertical channels 42 is so efficient that it can reduce the thermal flux to be evacuated by the fluid circuit. This reduction is advantageous in two cases: on the one hand, if an accidental failure affects the fluid circuit, the delay available for carrying out an intervention is much longer; on the other hand, over the long term, the date of ceasing utilisation of this fluid circuit taking into account the reduction of thermal flux is advanced significantly.

A variant of an embodiment according to the invention consists of extracting the air circulating in the vertical channels 42 in closed circuit, using means known to those skilled in the art. Furthermore, this variant has the advantage of producing a sealed barrier for supplementary confinement, raising security in the case of a possible accident situation, and avoiding affecting the storage air thermally.

Above all, it is to be noted that the jacket 28 also acts as a screen vis-à-vis the concrete structures on the site and that its temperature is lower than that of the jacket used in prior art since it is cooled on its two faces and is not in thermal continuity with the pipes 32.

Finally it is also observed that, because of the high performance of the installation according to the invention, the thermal conductivity of the materials used contributes very little to the thermal yield. Thus the designer has a much wider choice of materials than in prior art.

The invention claimed is:

1. Installation for very long term storage of calorific products, comprising at least one confinement container (14) for said products, an evaporator (22) comprising a jacket (28) surrounding the container (14) and a plurality of pipes (32) integral with the jacket (28) and filled with a coolant fluid, and means (40) for tightening the evaporator (22) on the container (14), characterised in that the evaporator (22) has an internal surface such that the tightening means (40)

maintain the evaporator (22) in close contact with an external surface (30) of the container (14) only in front of each of the pipes (32).

2. Installation according to claim 1, wherein the internal surface of the evaporator (22) has, between the pipes (32), a radius of curvature considerably greater than that of the external surface (30) of the container (14).

3. Installation according to either one or the other of claims 1 and 2, wherein the internal surface of the evaporator (22) comprises, in front of each of the pipes (32), a part (44) of shape complementary with the external surface (30) of the container (14), maintained in close surface contact with said external surface by tightening means (40).

4. Installation according to any one of claims 1 to 3, wherein the pipes (32) are fixed inside a continuous structure, of substantially circular cross-section, forming the jacket (28).

5. Installation according to claim 4, wherein the pipes (32) are fixed inside the jacket (28) by welding.

6. Installation according to claim 4, wherein the pipes (32) comprise cooling fins (32*a*) located between the jacket (28) and the container (14).

7. Installation according to any one of claims 1 to 2, herein each pipe (32) is made in a single piece with two jacket sections (28*a*) and the jacket sections (28*a*) integral with neighbouring pipes (32) are assembled together edge to edge to form the jacket (28).

8. Installation according to claim 7, wherein the jacket sections (28*a*) integral with neighbouring pipes (32) are assembled together by welding (54).

9. Installation according to either one or the other of claims 7 and 8, wherein the jacket sections. (28*a*) integral with neighbouring pipes (32) are assembled together by mechanical connection means (56).

10. Installation according to any one of claims 1 to 9, wherein the pipes (32) have a substantially square or rectangular cross-section.

11. Installation according to any one of claims 1 to 2, wherein the pipes (32) have a substantially circular cross-section.

12. Installation according to claim 10, wherein the pipes (32) have flanges (52) with one internal face maintained in close surface contact against the external surface (30) of the container (14) by tightening means (40).

13. Installation according to any one of claims 1 to 12, wherein an external surface of the evaporator (22) comprises cooling fins (58).

14. Installation according to any one of the above claims wherein, apart from zones located in front of the pipes (32), the evaporator (22) is at a distance from the container (14) so as to define vertical channels (42) for air circulation, by natural convection.

15. Installation according to claim 14, wherein the channels (42) are part of a closed circuit constituting a confinement.

* * * * *